US011242782B2

(12) United States Patent
Vargas

(10) Patent No.: US 11,242,782 B2
(45) Date of Patent: Feb. 8, 2022

(54) MUFFLER

(71) Applicant: R&R Holding & Leasing, Vernal, UT (US)

(72) Inventor: Rafael Vargas, Vernal, UT (US)

(73) Assignee: R&R Holding & Leasing, Vernal, UT (US)

( * ) Notice: Subject to any disclaimer, the term of this patent is extended or adjusted under 35 U.S.C. 154(b) by 450 days.

(21) Appl. No.: 16/263,888

(22) Filed: Jan. 31, 2019

(65) Prior Publication Data

US 2020/0248599 A1 Aug. 6, 2020

(51) Int. Cl.
*F01N 1/08* (2006.01)

(52) U.S. Cl.
CPC ..... *F01N 1/082* (2013.01); *F01N 2470/02* (2013.01); *F01N 2490/02* (2013.01)

(58) Field of Classification Search
CPC . F01N 1/08; F01N 1/082; F01N 1/084; F01N 1/088; F01N 1/006; F01N 1/089; F01N 2470/02; F01N 2490/02; F01N 2490/06
USPC ..... 181/251, 268, 265, 275
See application file for complete search history.

(56) References Cited

U.S. PATENT DOCUMENTS 1,950,455 A * 3/1934 Oldberg ..... F16L 55/02 181/266
2,186,062 A * 1/1940 Berg ..... F01N 13/185 181/266
2,928,492 A * 3/1960 Nelson ..... F01N 1/02 181/275
3,462,947 A * 8/1969 Nowak ..... F01N 1/084 60/314
3,771,315 A * 11/1973 Scott ..... F01N 3/04 60/297
4,467,887 A * 8/1984 Vizard ..... F01N 1/06 181/265
4,673,058 A * 6/1987 Roberts ..... F01N 1/02 181/256
5,304,749 A * 4/1994 Crandell ..... F01N 1/083 181/264
5,831,223 A * 11/1998 Kesselring ..... F01N 1/12 181/227
5,952,624 A * 9/1999 Hornback ..... F01N 1/08 181/255
5,959,263 A * 9/1999 Foltz, Jr. ..... F01N 1/084 181/254
7,044,266 B2 * 5/2006 Petracek ..... F01N 1/006 181/249
8,220,253 B2 * 7/2012 Werni ..... F01N 3/2066 60/301

(Continued)

FOREIGN PATENT DOCUMENTS

FR 2335696 A1 * 7/1977 ..... F01N 13/185
JP 02136506 A * 5/1990
JP 2016217152 A * 12/2016

*Primary Examiner* — Edgardo San Martin
(74) *Attorney, Agent, or Firm* — Workman Nydegger

(57) ABSTRACT

A muffler comprises a plurality of tubes disposed within an inner chamber. The holes are at least partially punched through the tubes so that hanging chads extend into the tubes at each hole. The tubes form a serpentine flow-path through the chamber through which exhaust flows. One or more diffusion brackets are also disposed within the chamber and downstream from one or more tube outlets.

20 Claims, 6 Drawing Sheets

(56) References Cited

U.S. PATENT DOCUMENTS

| | | | | |
|---|---|---|---|---|
| 8,424,636 | B2 * | 4/2013 | Jones | F01N 13/16<br>181/246 |
| 9,341,095 | B2 * | 5/2016 | Butler | F01N 1/085 |
| 9,488,079 | B2 * | 11/2016 | Bartlett | F01N 13/1872 |
| 2002/0162703 | A1 * | 11/2002 | Forsythe | F01N 1/084<br>181/252 |
| 2020/0102876 | A1 * | 4/2020 | Asano | F01N 13/08 |

* cited by examiner

MUFFLER

BACKGROUND

Technical Field

The present disclosure relates to mufflers. More specifically, the present disclosure relates to mufflers having improved exhaust flow and noise reduction features.

The Relevant Technology

Mufflers reduce noise emitted by the exhaust of internal combustion engines. Typical mufflers include a series of passageways and chambers through which exhaust from the engine travels. The passageways and chambers of the muffler, which may also be lined with acoustic packing material, diffuse and absorb high-pressure sound waves of the exhaust to reduce noise.

Typical mufflers include a perforated tube disposed within a chamber. During use, exhaust enters the tube and diffuses in and out of the tube through the perforations, thus diffusing the high pressure sound waves. The longer the tube and the more perforations available to diffuse exhaust, the greater the noise reduction of the muffler. Accordingly, greater sound reduction is often accomplished by increasing the length of the tube and number of perforations, which in turn increases the size of the muffler.

As a result, mufflers used for large engines, such as diesel engines that power oil rigs, must be very large to achieve acceptable noise reduction. Large mufflers are cumbersome, expensive, and unwieldy. Also, space may be limited on or around an engine so that a typical muffler may not provide sufficient noise reduction even if it is as large as possible given the space available.

Generally, the same features that diffuse exhaust within typical mufflers tend to also restrict the flow rate of exhaust coming out of the engine. This reduced exhaust flow rate decreases the efficiency of the motor, which increases fuel consumption and otherwise negatively effects engine performance. As such, increased noise reduction from the muffler is inversely related to engine efficiency. Therefore, one of the goals of muffler design is to minimize engine efficiency losses while achieving satisfactory noise reduction.

In addition, particulates carried in exhaust tend to clog perforations in the tubes of mufflers and accumulate in the packing material over time. This accumulation of particulates in the perforations and packing material diminishes the performance of the muffler. Clearing out accumulated exhaust particulates from the perforations and packing material is either not possible or cumbersome and time-consuming. Often, the effort and cost associated with cleaning out the muffler are greater than the effort and cost of total muffler replacement.

Accordingly, there are a number of problems in the art that need to be addressed. The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

The present disclosure relates to mufflers. More specifically, the present disclosure relates to mufflers having improved exhaust flow and noise reduction features. For example, in an embodiment of the present disclosure, a muffler includes an inner chamber defined by a removable outer shell extending between first and second endplates. The muffler also includes a plurality of tubes disposed within the inner chamber. At least one of the tubes communicates with an inlet of the muffler and at least one of the tubes communicates with an outlet of the muffler. In addition, the muffler includes a plurality of holes extending through each tube and a diffusion bracket disposed downstream from an outlet of one of the tubes.

In an embodiment of the present disclosure, a muffler includes a plurality of tubes disposed within an inner chamber. Each of the tubes includes an inlet, and outlet, a body extending between the inlet and outlet, a plurality of holes extending through the body, and a plurality of hanging chads. Each hanging chad extends from a perimeter edge of one of the holes and into an interior space of the tube. The muffler also includes a diffusion bracket disposed within the inner chamber and aligned with a longitudinal axis of one of the tubes.

In an embodiment of the present disclosure, a muffler includes an inner chamber, and three tubes. The first tube is connected to an inlet of the muffler and has an outlet disposed within the inner chamber. The second tube is connected to the outlet of the muffler and has an inlet disposed within the inner chamber. The third tube has an inlet and an outlet disposed within the inner chamber. The first, second, and third tubes form a serpentine flow-path through which at least a portion of exhaust entering the inner chamber flows during use. In addition, each of the tubes have a plurality of holes extending therethrough. The muffler also includes a first diffusion bracket disposed within the inner chamber.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Additional features and advantages of the disclosed embodiments will be set forth in the description which follows, and in part will be obvious from the description, or may be learned by the practice of the disclosure. These and other features will become more fully apparent from the following description and appended claims or may be learned by the practice of the present disclosure.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

The present disclosure relates to mufflers. More specifically, the present disclosure relates to mufflers having improved exhaust flow and noise reduction features. For example, in an embodiment of the present disclosure, a muffler includes an inner chamber defined by a removable outer shell extending between first and second endplates. The muffler also includes a plurality of tubes disposed within the inner chamber. At least one of the tubes communicates with an inlet of the muffler and at least one of the tubes communicates with an outlet of the muffler. In addition, the muffler includes a plurality of holes extending through each tube and a diffusion bracket disposed downstream from an outlet of one of the tubes.

Embodiments of the present disclosure solve one or more of the problems in the art discussed above. For example, one or more embodiments of the present disclosure may provide sufficient noise reduction of an internal combustion engine while minimizing the restriction of exhaust flow out of the engine. In addition, one or more embodiments of the present disclosure may provide noise reduction in a small, compact configuration. Also, one or more embodiments of the present disclosure may be easily disassembled and cleaned to reduce accumulation of exhaust particulates within various components of a muffler.

Figure 1:
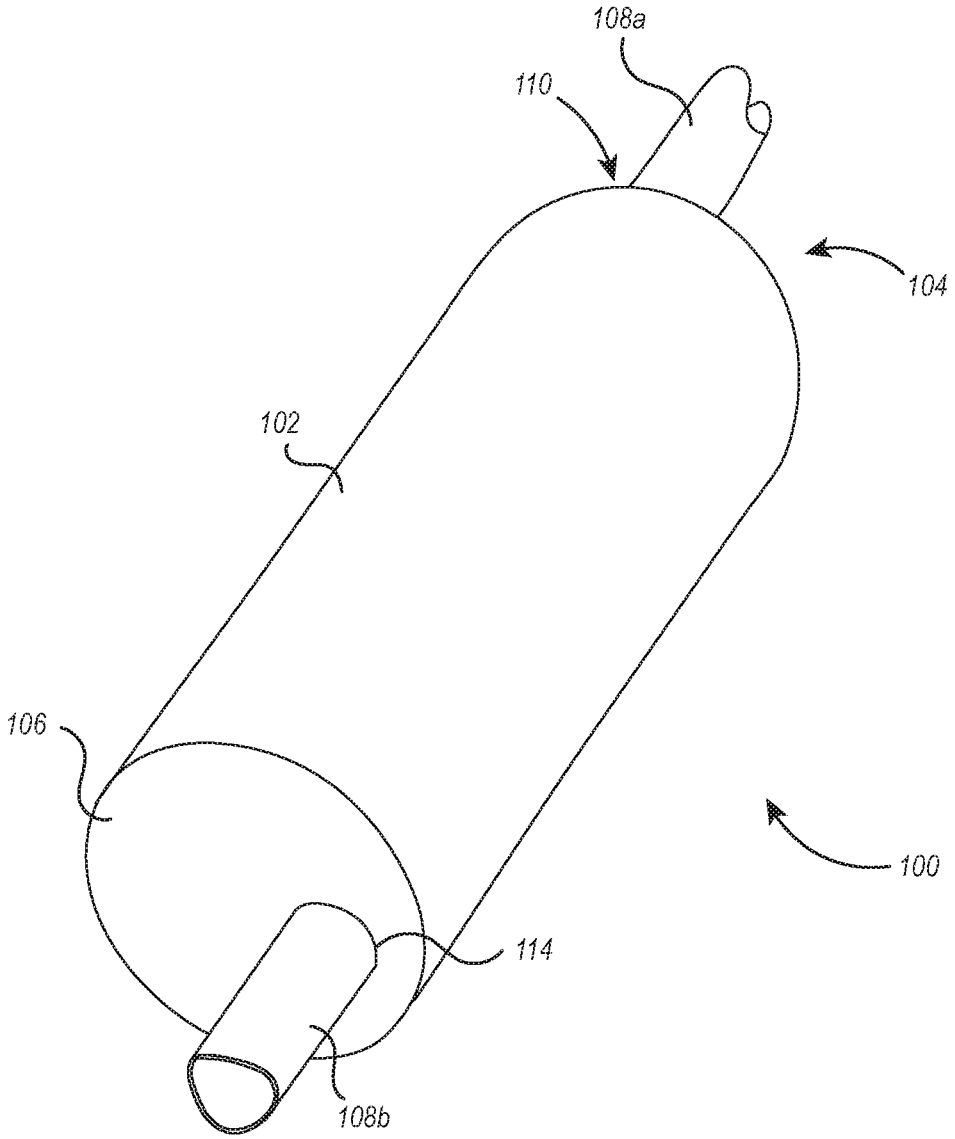
FIG. 1 illustrates a perspective view of an embodiment of a muffler.

Turning now to the figures, FIG. 1 illustrates a perspective view of an embodiment of a muffler 100. In the illustrated embodiment, the muffler 100 includes an outer shell 102 extending between first and second endplates 104, 106. Endplates 104, 106 and outer shell 102 define an inner chamber, which will be shown and described in more detail below. While endplates 104, 106 are shown as circular plates, one or more embodiments of the muffler 100 may include endplates 104, 106 of various other shapes and sizes. For example, in one or more embodiments, endplates 104, 106 may be oval, rectangular, triangular, polygonal, or otherwise irregularly shaped.

Regardless of the shape of the endplates 104, 106, the outer shell 102 extends between the endplates 104, 106 to define a prism-like structure and inner chamber of the muffler 100 having a cross-sectional shape of the endplates 104, 106. In general, the endplates 104, 106 may be any shape to accommodate the inner components of the muffler 100, described in more detail below. Also, the endplates 104, 106 and overall shape of the muffler 100 may be customized to accommodate a certain space within or around an engine to which the muffler is attached.

The various components of the muffler 100 described herein, including at least the removable outer shell 102 and endplates 104, 106 may comprise stainless steel. Stainless steel is advantageous in that it is resistant to rusting, thus making it ideal for uses in wet or humid environments. Additionally, or alternatively, other materials generally known and used in the art may also be used to form at least the outer shell 102 and end-plates. Other components other than the outer shell 102 and endplates 104, 106, including internal components of the muffler 100 described hereafter, may also comprise stainless steel or other materials generally known and used in the art.

FIG. 1 also illustrates a first tube 108*a* that enters the muffler 100 through a muffler inlet 110. The muffler inlet 110 may include an opening in the first endplate 104 through which the first tube 108*a* extends. Likewise, a second tube 108*b* extends out of the muffler 100 through a muffler outlet 114. The muffler outlet 114 may include an opening in the second endplate 106 through which the second tube 108*b* extends.

In one embodiment, the outer shell 102 may be removable so that inner components of the muffler 100 are accessible. This may be advantageous to allow access for a user to periodically clean or replace various components of the muffler 100. In one embodiment, the outer shell 102 is completely removable. In such an embodiment, the outer shell may be secured to the outer perimeter edges of each endplate 104, 106 via screws, bolts, snaps, hooks or other securement methods commonly known or used in the art.

Figure 2:
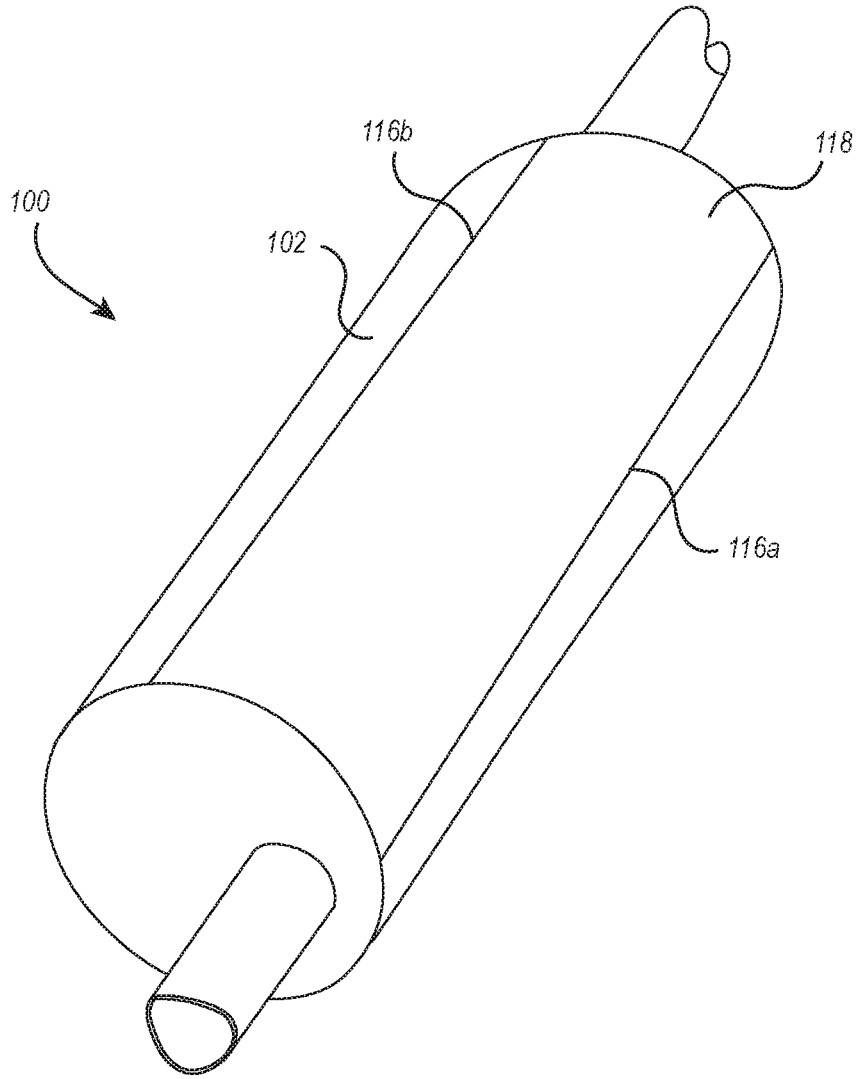
FIG. 2 illustrates a perspective view of an embodiment of a muffler.

Alternatively, in one or more embodiments, the outer shell 102 may be only partially removably secured to each endplate 104, 106. For example, in one embodiment shown in FIG. 2, only the portion 118 between seams 116*a*, 116*b* may be removable to allow access to the inside of the muffler 100. Alternatively, in one or more embodiments, the portion 118 may be a door that is hinged at one seam 116*b* and closed at the other seam 116*a*. In such an embodiment, the door 118 may include a latch or other temporary securement means (not shown) to hold the door 118 shut at seam 116*a*.

Along these lines, in one or more embodiments, the door 118 may extend around a majority of the circumference of the outer shell 102. In one or more embodiments, the door 118 may extend only partially around the circumference of the outer shell 102. One will appreciate, in light of the foregoing, that the outer shell 102 may be totally removable or partially removable to varying degrees to allow access to the inner chamber of the muffler 100.

Regardless of the extent of removability of the outer shell 102, in one or more embodiments, the muffler 100 may also include a seal (not shown) between the outer perimeter edge of each endplate 104, 106 and the edges of the removable portion of the outer shell 102. The seals may serve to maintain an air-tight closure of the inner chamber of the muffler 100. However, in one or more embodiments, the removable outer shell 102 may only loosely interface with the endplates 104, 106 so that exhaust moving through the muffler 100 is allowed to escape through space(s) at the interface to a degree, without negatively affecting the performance of the muffler 100.

Figure 3:
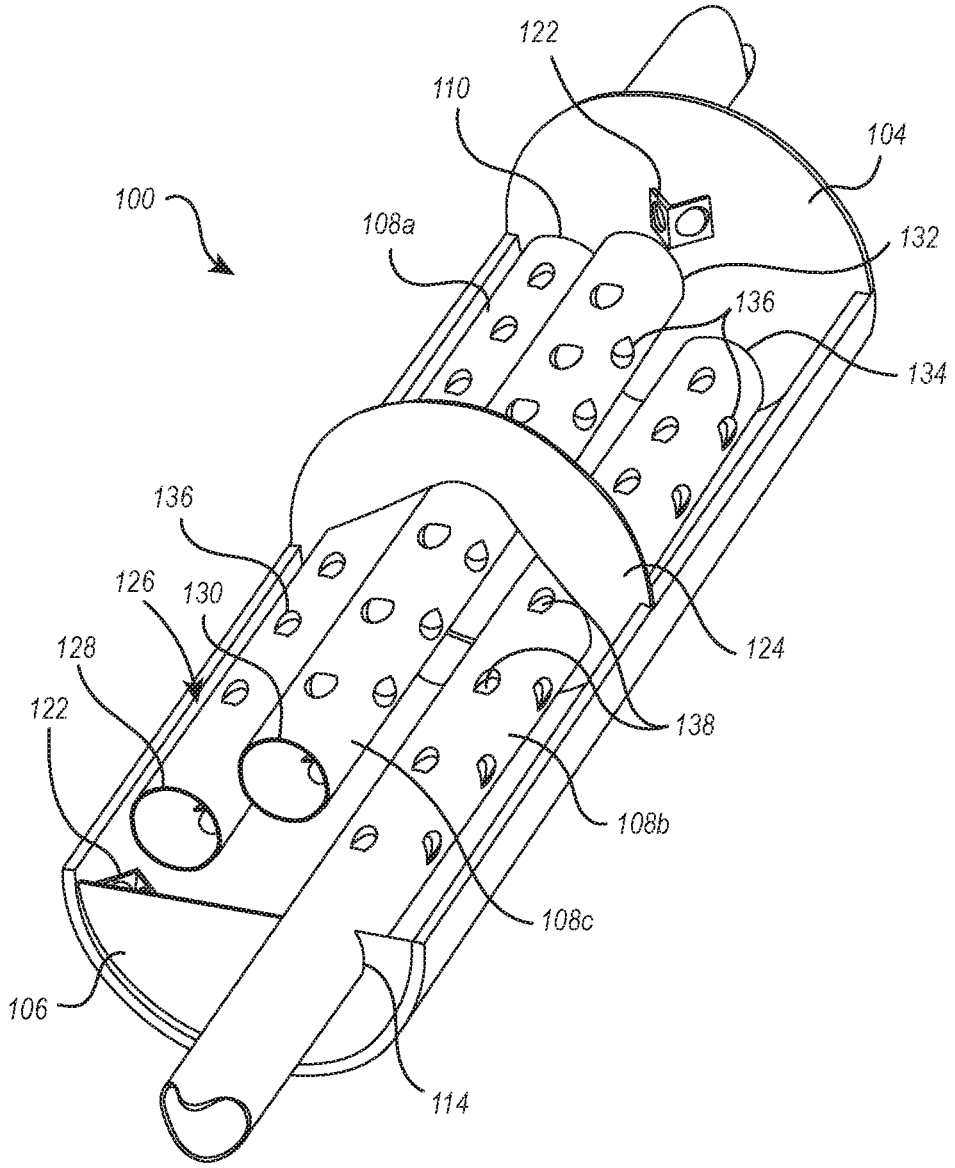
FIG. 3 illustrates a perspective view of an embodiment of a muffler with a portion of the outer cover of the muffler removed to expose inner components of the muffler for illustrative purposes, such as an inner plate, a plurality of tubes, and a plurality of diffusion brackets.

Moving on to FIG. 3, the muffler 100 is shown with the upper half of the outer shell 102 and second endplate 106 removed for illustrative purposes. In this view, the inner components of the muffler 100, mentioned above, can be seen inside the inner chamber 126. The inner components include at least a portion of the first tube 108*a*, at least a portion of the second tube 108*b*, as well as a third tube 108*c*. Other internal components include diffusion plates 122 and an inner plate 124.

In addition, while not illustrated in the Figures, the muffler 100 may also include acoustic packing material within the inner chamber 126 and between the tubes 108. As understood in the art, packing material may absorb high pressure sound waves of exhaust travelling through and out of the tubes 108 of the muffler 100. The acoustic packing material may include fiberglass insulation, ceramic fibers, or other materials commonly used in the art. In addition, in one or more embodiments, the packing material may comprise stainless steel, such as stainless-steel wool or other forms of stainless steel. Stainless steel packing material may be advantageous due to its resistance to rusting.

The acoustic packing material is not shown in the Figures for illustrative purposes so that other components, such as the tubes 108 and diffusion brackets 122, are shown. However, it is noted that the removable outer shell 102 described above may provide access to the acoustic packing material inside the inner chamber 126. This may be advantageous because packing material may need to be replaced periodically. For example, particulate matter from exhaust can build up in the packing material over time and reduce its sound absorption qualities. Access to the packing material via the removable outer shell 102 allows a user to quickly and easily remove old packing material and install new packing material.

The tubes 108 are arranged through the inner plate 124, which may help to secure the tubes 108 in place within the inner chamber 126. Additionally, or alternatively, the inner plate 124 may also structurally support the outer shell 102. As noted above, the first tube 108*a* extends through the muffler inlet 110 in the first endplate 104 and into the inner chamber 126. The first tube 108*a* also extends through the inner plate 124 and terminates within the inner chamber 126 at a first tube outlet 128.

The third tube 108*c* includes a third tube inlet 130 and extends through the inner plate 124 from the third tube inlet 130 to a third tube outlet 132. The third tube outlet 132 is also disposed within the inner chamber 126. The second tube 108*b* includes a second tube inlet 134 disposed within the inner chamber 126. The second tube 108*b* extends from the second tube inlet 134, through the inner plate 124, and out of the muffler 100 through the muffler outlet 114 in the second endplate 106. Each tube 108 includes a hollow, tubular body extending between the inlet and outlet of the tube 108. The tubular body defines a hollow interior space of the tube 108.

In the embodiment illustrated in FIG. 3, the muffler 100 includes three tubes 108 arranged generally parallel next to one another. In addition, the three illustrated tubes 108 are arranged in a triangular manner within the inner chamber 126. This triangular configuration of the tubes 108 utilizes space within the cylindrical inner chamber 126. However, as noted above, one or more embodiments of the muffler 100 may have endplates 104, 106 of different shapes so that a non-triangular arrangement of tubes 108 within the inner chamber 126 may be more appropriate to utilize the given space.

For example, in an embodiment of a muffler 100 having rectangular endplates forming an inner chamber 126 having a rectangular cross-section, the tubes 108 may be arranged adjacent to one another so that the third tube 108*c* is between the first and second tubes 108*a*, 108*b*. One will appreciate that any number of tube arrangements and relative positions may be achieved within the inner chamber 126 of the muffler 100.

In addition, one or more embodiments of the muffler 100 may include more or less than three tubes 108. For example, in one or more embodiments, the muffler 100 may include only two tubes. Also, for example, in one or more embodiments, the muffler 100 may include four or more tubes. Again, as noted above, the arrangement and relative positions of the tubes 108 may depend on the number of tubes disposed within the inner chamber 126 and the shape of endplates 104, 106.

As shown, in one or more embodiments, each tube 108 includes a plurality of holes 136 extending through the body thereof. The body of each tube 108 defines an outer perimeter edge of each hole 136. In addition, each hole 136 is only partially punched through the body of each tube 108 so that a hanging chad 138 remains attached to a portion of the outer perimeter edge of each hole 136.

The various features of the muffler 100 noted above, including the holes 136, hanging chads 138, diffusion brackets 122, inner plate 124, and other features of the muffler 100 described below in greater detail with reference to FIGS. 4-8*b*. Accordingly, reference is now made to FIG. 4, which illustrates a top view of the muffler 100 shown in FIG. 3. In general, the arrangement and relative positions of the tubes 108 form a serpentine flow-path extending from the muffler inlet 110 to the muffler outlet 114.

For example, exhaust from an engine may enter a first tube inlet 140 and travel through the hollow body of the first tube 108*a* to the first tube outlet 128. The inner plate 124 separates the inner chamber 126 into first and second sub-chambers 142, 144. In one or more embodiments, exhaust may travel through the first tube 108*a*, through the first sub-chamber 142, and across the inner plate 124 to the second sub-chamber 144. Exhaust may then flow out of the first tube 108*a* through the first tube outlet 128 and then back into the third tube 108*c* through the third tube inlet 130.

The exhaust flow-path may then be directed through the third tube 108*c* and back into the first sub-chamber 142 through the third tube outlet 132. The flow-path of exhaust may then be directed through the second tube 108*b*, where exhaust enters the second tube inlet 134 and out the muffler through the muffler outlet 114 and ultimately out through the second tube outlet 146. Thus, according to the illustrated embodiment of FIGS. 3 and 4, the muffler 100 provides a serpentine flow-path through which exhaust from an engine may flow.

It will be appreciated that the flow-path described above can vary in different embodiments described herein. For example, in an embodiment of a muffler having only two tubes 108, the serpentine flow-path may enter through a first tube through the first endplate 104 and then turn and exit through an outlet that is also disposed in the first endplate 104. Also, for example, in an embodiment having four or five tubes disposed within the inner chamber 126, the serpentine flow-path may direct exhaust across the inner plate 122 from one side of the muffler 100 to the other (or from the first sub-chamber 142 to the other 144) four or five times before exiting the muffler 100.

As such, tubes 108 may be arranged within the inner chamber 126 of the muffler 100 to achieve any number of flow-paths directing exhaust from an engine through the muffler 100. In general, the flow-paths described in the present disclosure are serpentine, meaning exhaust flows back-and-forth through the tubes 108 from one side of the muffler 100 to the other, as described above.

One advantage of the serpentine flow-path configurations described in the present disclosure is the reduction in overall length L of the muffler 100. This serpentine configuration of the flow-path is produced by the relative positioning of the tubes 108 next to one another within the inner chamber 126. In such a configuration, the length of the flow-path can be increased by adding more tubes within the inner chamber without increasing the overall length L of the muffler 100.

One will also appreciate that the flow-path defined by the tubes 108, and described above, provides a general flow-path through which only a portion of exhaust from an engine may flow. The holes 136 also provide alternative flow-paths through which at least a portion of the exhaust may also flow. These alternative flow-paths may carry exhaust from one tube to another within the same sub-chamber 142, 144. Exhaust may flow out each hole 136 in the tubes 108 and re-enter the same or other holes 136, either back into the same tube 108 or into another tube 108.

In addition, in one or more embodiments, the inner plate 124 may be configured to allow exhaust to pass from one sub-chamber 144, 142, to another without travelling through a tube 108. More detail regrading various configurations of the inner plate 124 is given below with reference to FIGS. 8A and 8B. However, it is noted here that in one or more embodiments, the inner plate 124 may, but does not necessarily, allow exhaust to flow thereacross outside the tubes 108. In this way, the alternative flow-paths described above may include exhaust crossing the inner plate 124 in either direction outside any of the tubes 108.

One will appreciate that the number of alternative flow-paths available for the exhaust to flow through the muffler 100 are, in effect, limitless. The flow-path provided by the tubes 108, in combination with the alternative flow-paths described above, result in the diffusion of exhaust flowing through the muffler 100. This diffusion may result in high pressure sounds waves of the exhaust being dampened to reduce noise. As noted above, typically the more diffusion, the greater the sound reduction. Also, as noted above, increasing the length of the flow-path tends to increase diffusion.

Thus, the muffler of the present disclosure is advantageous in that increased diffusion (and thus improved noise reduction) may be achieved without increasing the total length L and size of the muffler 100. This is due to the serpentine arrangement of the flow-path through the multiple tubes 108 arranged within the inner chamber 126, as described above.

Figure 5:
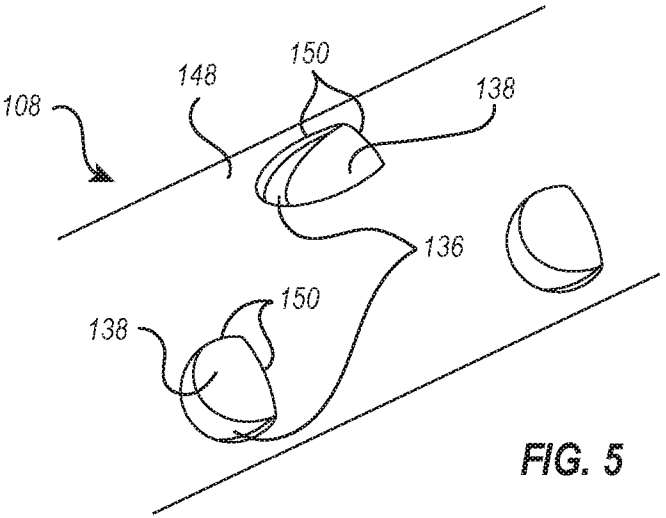
FIG. 5 illustrates a close-up perspective view of an embodiment of a tube having a plurality of holes punched therethrough and a hanging chad extending from the outer perimeter of each hole.

FIG. 5 illustrates a close-up perspective view of an embodiment of a tube 108 having a plurality of holes 136 extending through the body 148. The body 148 of the tube 108 at least partially defines an outer perimeter edge 150 of each hole 136. In addition, a hanging chad 138 extends from the outer perimeter edge 150 of each hole 136 and into the tube 108.

The holes 136 extending through the body 148 of the tube 108 at least partially determines the available area through which exhaust may flow in and out of the tube 108. In one or more embodiments, the diameter of the holes 136 may be between about ½-inch and 1-inch. In one or more embodiments, the diameter of the holes 136 may be between about ⅝-inch and ⅞-inch, and preferably about ¾-inch. Alternatively, in one or more embodiments the holes 136 may have a diameter greater than 1-inch or less than ½-inch, including 1½-inches, 2-inches, 2½-inches, 3-inches, ⅜-inch, ¼-inch, or ⅛-inch.

In addition, one or more embodiments may include a combination of holes of various sizes. Accordingly, a manufacturer can vary the diameter of each hole 136 to customize and optimize the outflow and inflow of exhaust, and thus the diffusion of exhaust, flowing through each tube 108.

Figure 6:
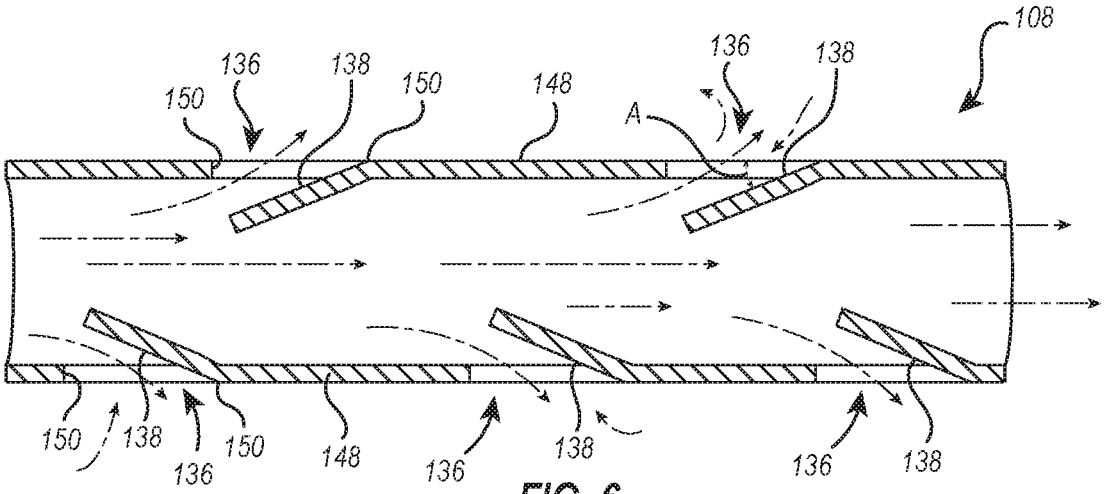
FIG. 6 illustrates a longitudinal cross-section view of an embodiment of a tube with air flowing therethrough.

FIG. 6 illustrates a longitudinal cross-section view of an embodiment of a tube 108 with air flowing therethrough. The illustrated embodiment shows a number of holes 136 and associated hanging chads 138 extending from the body 148 and into the tube 108. The arrows indicate the direction of exhaust flow inside and outside the tube 108. A portion of the exhaust may follow the flow-path within the tube 108 while a portion of the exhaust may follow alternative flow-paths in and out of the various holes 136.

In the embodiment of the tube shown in FIG. 6, the hanging chads 138 are angled toward the oncoming flow of exhaust travelling in the flow-path through the interior of the tube 108. Hanging chads 138 angled toward the oncoming flow of exhaust through the tube 108 are angled toward the inlet of the tube 108. Hanging chads 138 angled toward the oncoming flow of exhaust within the tube 108 may tend to promote flow of exhaust out of the tube 108. The angle A of the hanging chads 138 relative to the body 148 may vary in one or more other embodiments. For example, in one or more embodiments, the angle A of each hanging chad 138 may range between zero and 180-degrees relative to the body, while extending into the interior of the tube 108.

The angle A of the hanging chads 138 extending into the interior of the tube 108 at least partially determines the available area through which exhaust may flow in and out of the associated hole 136. For example, a hanging chad angled at 10-degrees would occlude the opening of the hole 136 to a greater degree than a hanging chad angled at 45-degrees. In one or more embodiments, each tube 108 may include hanging chads 136 disposed at a variety of different angles. Accordingly, a manufacturer can vary the angle A of each hanging chad 138 to control and customize the outflow and inflow of exhaust, and thus the diffusion of exhaust, flowing through each tube 108.

In addition, the available area through which exhaust may flow out of any given hole 136 is determined at least in part by how much of the outer perimeter edge 150 is shared with a hanging chad 138. As noted above, and with reference to FIG. 5, each hanging chad 138 may extend from the body 148 of the tube 108 and be connected to a portion of the outer perimeter edge 150 of the hole 136. The larger the connection between the outer perimeter edge 150 of the hole 136 and the hanging chad 138, the smaller the opening provided by the hole 136 through the body 148, and vice versa.

Along these lines, in one or more embodiments, each hanging chad 138 may be connected to between about 10% and 30% of the outer perimeter edge 150 of the hole 136 from which the hanging chad 138 extends. In one or more embodiments, each hanging chad 138 may be connected to between about 15% and 25% of the outer perimeter edge 150 of the hole 136 from which the hanging chad 138 extends. In one or more embodiments, each hanging chad 138 may be connected to about 20% of the outer perimeter edge 150 of the hole 136 from which the hanging chad 138 extends.

Also, one or more embodiments may include a combination of hanging chads 138 connected to the outer perimeter edges 150 of the holes 136 to varying degrees, as described above. Accordingly, a manufacturer can optimize diffusion through the holes 136 by varying the degree to which the hanging chads 138 share the outer perimeter edge 150 of each hole 136. These variations and combinations of hanging chad 138 connections may be varied based on hole position along the length of each tube 108. These variations or combinations may also be a function of which tube 108 the hanging chads 138 are extending into.

By combining and/or varying the percentage of the outer perimeter edge 150 that is shared with a hanging chad 138, the manufacturer can vary the size/area of each hole 136 and thus optimize diffusion of exhaust through the holes 136 and throughout the muffler 100. For example, due to head losses and flow pressure gradients within the tube 108, it may be advantageous to vary the size of the holes 136 along the length of each tube 108. In this way, the manufacturer can evenly distribute, or otherwise customize the distribution of exhaust flowing out from the holes 136 along the length of each tube 108. Such customization can maximize diffusion and sound reduction within the muffler 100. In fact, any other parameters that determine the area through which exhaust flows out of the holes 136, including hole diameter and the angle A discussed above, can be customized and varied along the length of each tube 108 to customize the distribution of exhaust out of the tubes 108, thus optimizing the sound reduction capacity of the muffler 100.

In addition, in one or more embodiments, one or more of the hanging chads 138 may be attached to the other side of the outer perimeter edge 150 of a hole 136 and angled inward toward the interior of the tube 108. In such an embodiment, the one or more hanging chad 138 may be angled away from oncoming exhaust flow within the tube 108. A hanging chad 138 angled away from oncoming flow of exhaust may tend to promote exhaust flowing into the interior of the tube 108 from the inner chamber 126 outside the tube 108.

Along these line, in one or more embodiments, each tube 108 may include a combination of hanging chads 138 described in various embodiments above, some angled toward oncoming flow and some angled away from oncoming flow. Accordingly, a manufacturer can customize the flow-path and alternative flow-paths described above by varying the angles and arrangement of the hanging chads 138, either promoting inflow of exhaust, outflow of exhaust, or both. Exhaust flow diffusion and resulting noise reduction may also be optimized in this way.

Figure 7:
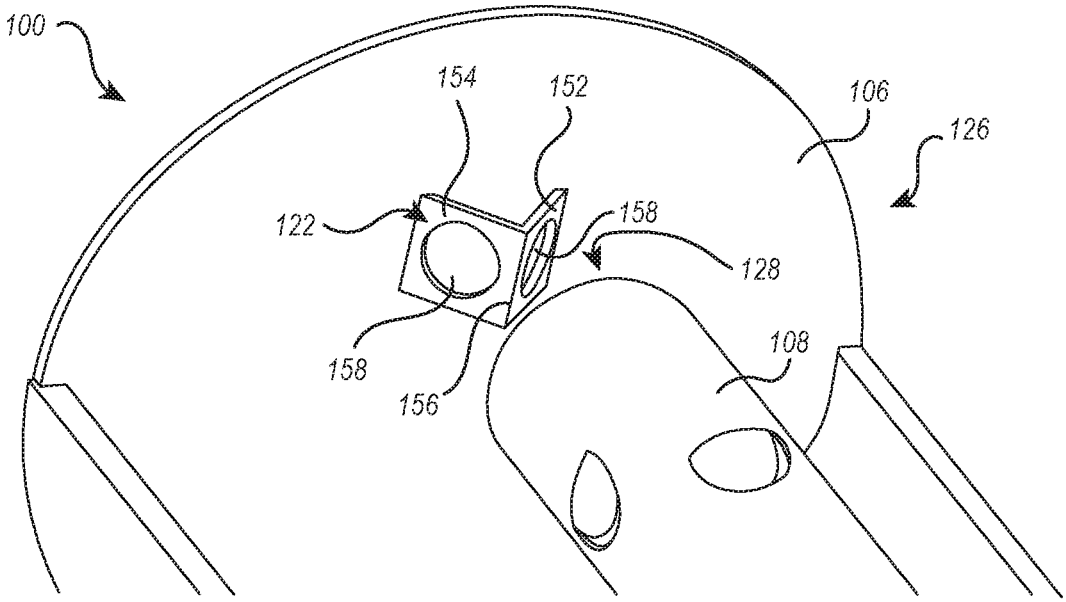
FIG. 7 illustrates a perspective view of an embodiment of a tube and a diffusion bracket disposed downstream from the outlet of the tube on an inside surface of the endplate.

FIG. 7 illustrates a perspective view of an embodiment of a tube 108 and a diffusion bracket 122 disposed on the inside of the second endplate 106. As noted above and illustrated in FIGS. 3 and 4, the diffusion bracket 122 may be disposed downstream from the outlet 128 of the tube 108. In one or more embodiments, the diffusion bracket 122 includes a first face 152, a second face 154, and an edge 156 where the two faces meet. In the illustrated embodiment, the edge 156 is disposed toward the outlet 128 of the tube 108 so that the faces 152, 154 of the diffusion bracket 122 are both angled away from the tube 108.

In addition, one or more embodiments of the diffusion bracket 122 may include one or more holes 158 extending through either face 152, 154. The holes 158 may provide alternative pathways through which exhaust may flow, either as part of the serpentine flow-path or alternative flow-paths described above. One or more embodiments of the muffler 100 may include diffusion brackets 122 that have more or less than the number of holes 158 illustrated in FIG. 7. In addition, the size and arrangement of the holes 158 in different embodiments may vary to promote optimal diffusion of exhaust flowing therethrough.

Figure 4:
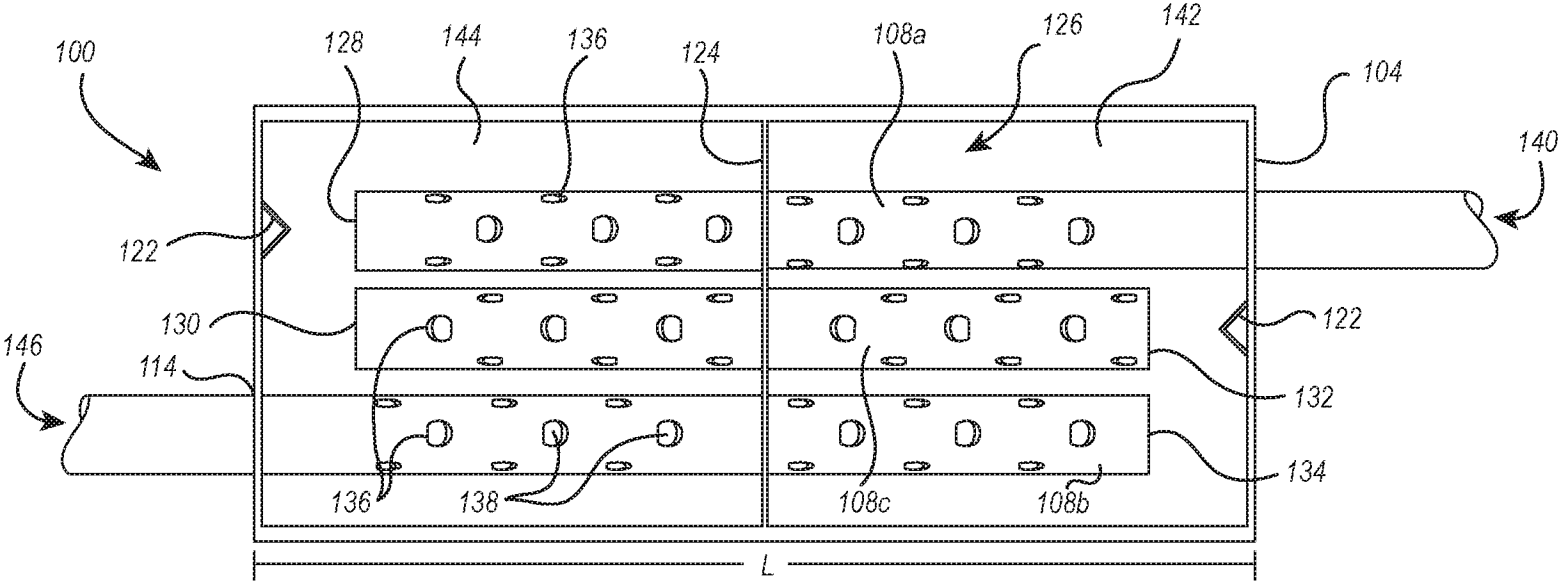
FIG. 4 illustrates a top view of an embodiment of a muffler with a portion of the outer cover removed to illustrate inner components, such as an inner plate, a plurality of tubes, and diffusion brackets.

The diffusion bracket may also be disposed on an inside surface of either endplate 104, 106. In the illustrated embodiment of FIG. 7, the diffusion bracket 122 is disposed on an internal surface of the second endplate 106 and aligned with a longitudinal axis of the tube 108. The longitudinal alignment of the diffusion bracket 122 with the tube 108 is also illustrated in FIGS. 3 and 4. In this way, at least a portion of the exhaust flowing out of the outlet 138 of the tube 108 encounters the diffusion bracket 122 before it encounters the endplate 106. As such, the diffusion bracket 122 may diffuse at least a portion of the exhaust exiting the outlet 128 before it meets the flat interior surface of the endplate 106. The effect of the diffusion bracket 122 may therefore be to diffuse and further reduce noise and high-pressure acoustic waves traveling toward the endplate 106. Otherwise, with no diffusion bracket 122, high pressure acoustic waves may reflect off the flat endplate 106, resulting in un-dampened reflections.

As shown in FIGS. 3, 4, and 7, one or more embodiments of the muffler 100 may include a diffusion bracket 122 disposed downstream from each tube outlet 128, 132 disposed within the inner chamber 126 to diffuse exhaust flowing toward each endplate 104, 106. However, in one or more embodiments, a muffler may include additional diffusion brackets 122, including more than one diffusion bracket 122 disposed downstream from each tube outlet 128, 132. This may include a diffusion bracket 122 disposed downstream from the first tube outlet 128 of the first tube 108*a* and a diffusion bracket disposed downstream from the third tube outlet 132 of the third tube 108*c*.

One will appreciate that the number, size, and arrangement of diffusion brackets 122 may vary between embodiments having a different number and arrangement of tubes 108. Accordingly, a manufacturer can arrange the various diffusion brackets 122 of the muffler 100 to optimize exhaust flow diffusion within the inner chamber 126.

Figure 8A:
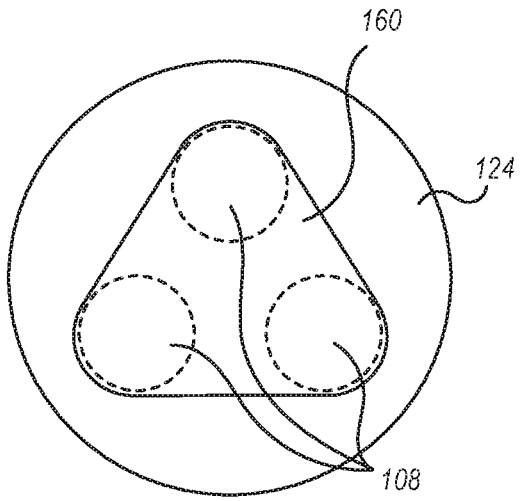
FIG. 8A illustrates a front view of an embodiment of an inner plate having three tubes arranged through a triangular opening of the inner plate.
Figure 8B:
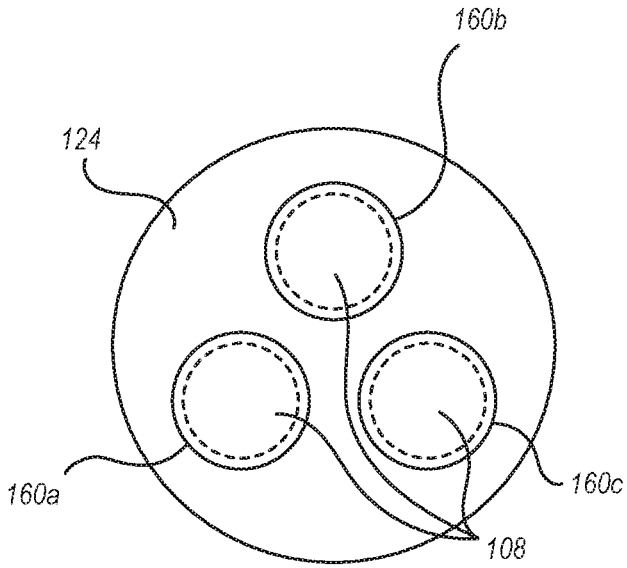
FIG. 8B illustrates a front view of an embodiment of an inner plate having three tubes arranged through three circular openings of the inner plate.

Turning now to FIGS. 8A and 8B, two embodiments of an inner plate 124 are shown. FIG. 8A illustrates a front view of an embodiment of an inner plate 124 having three tubes 108 arranged through a triangular opening 160. As noted above, the tubes 108 may or may not be supported by the inner plate 124 within the opening 160. The dotted lines representing the tubes 108 merely indicate general positions of the tubes 108 as illustrated and described in the embodiments of the present disclosure.

For example, in one or more embodiments, space may be provided between and/or around various tubes 108 extending through the opening 160 of the inner plate 124. In such embodiments, alternative flow-paths described above may include pathways outside the tubes 108 and through the opening 160 of the inner plate 124. Also, in one or more embodiments, the inner plate 124 may also include other openings (not shown) through which no tubes 108 are disposed but through which exhaust may flow.

An alternative embodiment of an inner plate 124 is illustrated in FIG. 8B. In this embodiment, the inner plate 124 includes a separate opening 160*a-c* for each tube 108 extending through the inner plate 124. Such an embodiment may restrict flow of exhaust through the inner plate outside of the tubes 108 to a greater degree than the embodiment illustrated in FIG. 8A.

One will appreciate that the number, size, and arrangement of the openings 160 in the inner plate 124 may vary between embodiments to accommodate various tube 108 configurations and positions. In addition, one or more embodiments of a muffler may include more than one inner plate 124, including a combination of the different embodiments of inner plates 124 described herein.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A muffler, comprising:

an inner chamber at least partially defined by a removable outer shell extending between first and second endplates;

an inlet and an outlet;

a plurality of tubes disposed within the inner chamber, at least one of the plurality of tubes communicating with the inlet of the muffler and at least one of the plurality of tubes communicating with the outlet of the muffler;

a plurality of holes extending through each of the plurality of tubes; and a diffusion bracket disposed within the inner chamber and downstream from an outlet of one of the plurality of tubes, the diffusion bracket having at least one hole extending therethrough.

2. The muffler of claim 1, wherein each tube comprises a body extending from a tube inlet and a tube outlet, and wherein the body of each tube defines an outer perimeter edge of each of the plurality of holes.

3. The muffler of claim 2, wherein a hanging chad is connected to the outer perimeter edge of each hole.

4. The muffler of claim 1, wherein the diffusion bracket comprises a first face and second face formed at an angle relative to one another, the angle forming a bracket edge between the two faces.

5. The muffler of claim 1, wherein the diffusion bracket is mounted on the second endplate and is downstream from the outlet of a first tube of the plurality of tubes.

6. The muffler of claim 4, wherein the bracket edge is disposed toward the outlet of one of the plurality of tubes so that the first and second faces of the diffusion bracket extend away from the outlet of the tube.

7. The muffler of claim 1, wherein the plurality of tubs comprise a first tube associated with the inlet, a second tube associated with the outlet, and a third tube extending partially between the first and second endplates, the diffusion bracket comprising:

a first diffusion bracket disposed on at the second endplates downstream of an outlet of the first tube; and a second diffusion bracket disposed on the first endplate downstream of an outlet of the third tube.

8. The muffler of claim 7, wherein the diffusion bracket comprises an angled bracket having two faces, each of the two faces having one or more holes extending therethrough.

9. A muffler, comprising:

a plurality of tubes disposed within an inner chamber, each of the plurality of tubes comprising:

an inlet;

an outlet;

a body extending between the inlet and outlet;

a plurality of holes extending through the body, each hole having an outer perimeter edge defined by the body; and a plurality of hanging chads, each hanging chad extending from the outer perimeter edge of a hole and into an interior space of the tube, at least one hanging chad extending into the interior space of the tube at an angle away from the inlet in the tube; and a diffusion bracket disposed within the inner chamber, the diffusion bracket being aligned with a longitudinal axis of one of the plurality of tubes.

10. The muffler of claim 9, wherein a major diameter of each of the plurality of holes is between about ½-inch and 1-inch.

11. The muffler of claim 9, wherein a major diameter of each of the plurality of holes is between about ⅝-inch and ⅞-inch.

12. The muffler of claim 9, wherein one or more hanging chad extend at an angle toward the inlet.

13. The muffler of claim 12, wherein each hanging chad is connected to between about 10% and 30% of the outer perimeter edge of the hole from which the hanging chad extends.

14. The muffler of claim 12, wherein each hanging chad is connected to between about 15% and 25% of the outer perimeter edge of the hole from which the hanging chad extends.

15. A muffler, comprising:

an inner chamber;

an inner plate separating the inner chamber into first and second sub-chambers;

a first tube connected to an inlet of the muffler, the first tube extending from the inlet, through the first sub-chamber, through the inner plate, and into the second sub-chamber, the first tube having an outlet disposed within the second sub-chamber;

a second tube connected to an outlet of the muffler, the second tube extending from the outlet, through the second sub-chamber, through the inner plate, and into the first sub-chamber, the second tube having an inlet disposed within the first sub-chamber;

a third tube extending between the first and second sub-chambers and through the inner plate, the third tube having an inlet disposed in the second sub-chamber and an outlet disposed in the first sub-chamber; and a first diffusion bracket disposed downstream from the outlet of the first tube within the second sub-chamber; and a second diffusion bracket disposed downstream from the outlet of the third tube within the first sub-chamber, wherein each tube comprises a plurality of holes extending therethrough, wherein a first subset of the plurality of holes are disposed in the portion of the tube that is disposed in the first sub-chamber and a second subset of the plurality of holes are disposed in the portion of the tube that is disposed in the second sub-chamber, and wherein the first, second, and third tubes form a serpentine flow-path through which at least a portion of exhaust entering the inner chamber flows during use.

16. The muffler of claim 15, wherein the outlet of the first tube and the inlet of the third tube are aligned with one another and the outlet of the third tube and the inlet of the second tube are aligned with one another.

17. The muffler of claim 16, wherein the serpentine flow-path crosses the inner plate and between the first and second sub-chambers.

18. The muffler of claim 15, wherein the inner plate comprises one or more openings therein through which exhaust may flow directly between the first and second sub-chambers.

19. The muffler of claim 15, wherein each of the first and second diffusion brackets comprise one or more holes extending therethrough.

20. The muffler of claim 15, further comprising a plurality of hanging chads, each hanging chad extending from a perimeter edge of one of the plurality of holes and into an interior space of the tube through which the hole extends, at least one hanging chad being angled away from the inlet of the tube into which the chad extends.

* * * * *